United States Patent [19]

Schultz

[11] 3,976,207

[45] Aug. 24, 1976

[54] CASING STABBING APPARATUS

[75] Inventor: Richard A. Schultz, Houston, Tex.

[73] Assignee: BJ-HUGHES Inc., formerly Byron Jackson, Inc., Houston, Tex.

[22] Filed: Apr. 7, 1975

[21] Appl. No.: 565,953

[52] U.S. Cl. ..... 214/2.5; 137/342; 175/85; 214/1 P; 214/83.1

[51] Int. Cl.[2] ..... E21B 19/14

[58] Field of Search ..... 175/85, 52; 137/342; 214/2.5, 3.1, 16 B, 653, DIG. 3, 83.1, 1 P, 1 SW, 1 D

[56] References Cited

UNITED STATES PATENTS

| | | | |
|---|---|---|---|
| 2,479,623 | 8/1949 | Johnson | 214/1 D UX |
| 3,409,158 | 11/1968 | Lull | 214/1 H X |

*Primary Examiner*—Robert J. Spar
*Assistant Examiner*—George F. Abraham

[57] ABSTRACT

Apparatus for stabbing casing pipe as the casing is being run into a well bore. It includes a casing handling head arranged for grasping a generally upright section of casing pipe near the upper end thereof. The head is controllable for movement in a horizontal plane extending over the well bore and is movable vertically also. An operator platform is attached to the head for movement therewith. The platform has control means mounted thereon for operating the head, whereby an operator supported on the platform can visually observe and guide stabbing of a section of casing pipe and release the same by operating the control means. The position of the platform is such that an operator supported thereon can carry out other manipulative steps associated with the casing stabbing operation, as for example, the operation of the elevators, the pipe slings, and the like.

7 Claims, 4 Drawing Figures

CASING STABBING APPARATUS

BACKGROUND OF THE INVENTION a. Field of the Invention

This inventin relates to a casing stabbing apparatus for running casing pipe into a well bore.

b. Description of the Prior Art

During the running of casing pipe into a well bore, it has heretofore been customary practice to raise an add-on section of casing pipe into the derrick by the use of wireline slings or the like. Thereafter, the add-on section is moved to the proper vertical alignment for stabbing of the lower pin end of the casing pipe into the upper box end of the casing pipe string being supported in the well bore by appropriate slips or the like. Once the add-on section of casing pipe is properly axially aligned, then conventional power tongs are utilized to rotate the same, thereby threading the add-on section into the upper end of the casing being supported in the aforesaid slips. However, the stabbing operation for adding on a section of casing pipe is much more critical than with other types of pipe, as for example, conventional drill pipe. This arises out of the fact that casing pipe have a different type thread configuration, with the result that axial alignment is more important in performing the casing stabbing operation.

Heretofore, the add-on section of the casing pipe has been manipulated by an observer positioned on the derrick floor. However, an operator so located is not in the best position for observing the proper axial alignment and performing other required manipulative steps. As a result, there have been developed what are called casing stabbing platforms, which are suspended on wirelines held within the derrick, such that an operator supported thereon can be raised above the derrick floor to obtain a better view of the stabbing operation and thereby direct such operations from such vantage point. In certain instances, apparatus of the aforesaid type permit the operator to manually apply the proper lateral forces to the add-on section to perfect the axial alignment while the add-on section is actually being supported by a conventional elevator or sling. However, these type of prior art devices are not fully satisfactory for the reason that such platforms are not very stable; the operator is not situated proximate to not very stable; the operator is not situated proximate to the add-on section at all times; and such operator cannot control the axial stabbing operation in most instances. Moreover, in those instances where the operator must physically apply lateral forces to the add-on section, great manual effort is required in certain instances, which is not very satisfactory.

SUMMARY OF THE INVENTION

It is, therefore, an object of this invention to provide an improved casing stabbing apparatus which will overcome the aforesaid problems.

Briefly stated, this invention is for a casing stabbing apparatus for running casing pipe into a well bore. It includes, in combination, a casing handling head for grasping a generally upright section of casing pipe. The head is controllably movable along two intersecting horizontal axes extending over the well bore. The casing head is also movable vertically along a vertical axis. The invention includes a platform attached to the head for movement therewith. The platform is adapted for supporting an operator thereon. In addition, the platform has mounted thereon control means for operating the aforesaid casing head, whereby an operator supported on the platform can visually observe and guide the stabbing section of casing pipe and thereafter release the same by operating the control means.

In certain instances, the apparatus may include a second casing head adapted to grasp the pipe at a point spaced below the first casing head to further facilitate manipulation thereof and which lower head is also controllable by control means mounted on the platform.

DESCRIPTION OF THE PREFERRED EMBODIMENT

Figure 1:
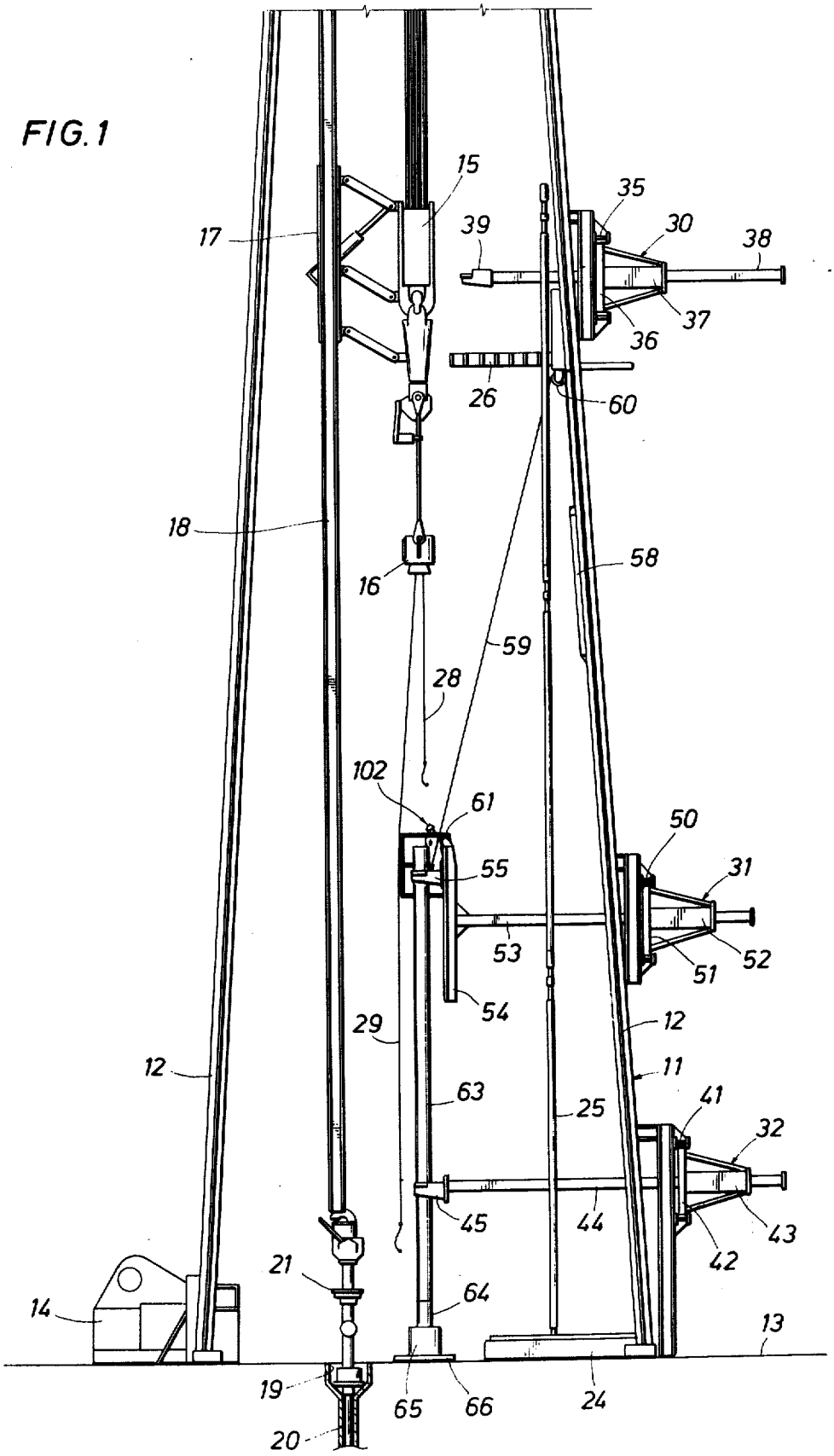
FIG. 1 is a side elevation view of an oil well derrick showing the apparatus of this invention mounted therein.

Referring now to FIG. 1, the numeral 11 generally designates a derrick having four derrick legs 12 mounted on and extending upwardly from a deck 13. Deck 13 has mounted thereon conventional drawworks 14 for operating various portions of the drilling apparatus, including traveling block 15 shown supported in Derrick 11. Traveling block 15 is shown having supported thereon and depending therefrom elevator 16 of the type for engaging and lifting a string of casing pipe. Elevator 16 has attached thereto and depending therefrom an upper wireline sling 28 and lower wireline sling 29 which are of conventional design and which are arranged for latching about the end of a section of pipe such as casing pipe, whereby such pipe can be lifted into position into derrick 11 by upward movement of traveling block 15, as will be described hereinafter.

Block 15 is shown arranged for movement to and from the central position shown by means of hook block retractor assembly 17 which is of the general type shown in U.S. Pat. No. 3,507,405. Assembly 17 is connected to a guide track 18 also supported in derrick 11 with the lower end thereof positioned generally vertically over a rat-hole 19 provided in deck 13. Rat-hole 19 is shown having supported therein a portion of the drilling apparatus which is then not in use and including kelly 20 which has attached to the upper end thereof a convention swivel 21.

Deck 13 also has mounted thereon a pipe rack base 24 shown having supported thereon a stand of drill pipe 25 which is held in the retracted position by finger board 26 of the type shown in U.S. Pat. Nos. 3,768,663 and 3,561,811, for example.

Derrick 11 has mounted therein an upper racker assembly 30, an intermediate pipe racker assembly 31 and a lower pipe racker assembly 32. Racker assemblies 30, 31 and 32 are substantially identical with and operate in the same manner as racker assemblies 51, 52 and 62 shown and taught in U.S. Pat. No. 3,561,811. By way of further explanation, upper assembly 30 includes a horizontal carriage track 35 extending horizontally or laterally between the derrick legs 12 shown on the right hand side of FIG. 1. Track 35 has supported therein for lateral movement thereon upper carriage 36 which supports a laterally extending guide 37 and which is mounted for axial movement therein upper arm 38 having a racking head 39 on the radially inward end thereof. Head 39 has a hydraulically actuated latch for grasping a piece of pipe and moving the same laterally within derrick 11, as desired. Lower rack assembly 32 is substantially similar to upper racker assembly 30 and includes a horizontal track 41 which extends between derrick legs 12 on the right side of the derrick 11 as shown in FIG. 1. Track 41 has mounted thereon for lateral or horizontal traverse thereon carriage 42 which has attached therewith laterally extending guide 43 in which has mounted for axial movement therein lower arm 44, the radially inward end of which has attached thereto racking head 45 which is similar to racking head 39.

Intermediate racker assembly 31 also includes a carriage track 50 which extends between two derrick legs 12 in the same manner as racker assemblies 30 and 32 and on which is mounted a carriage 51 for lateral or horizontal traverse thereon. Carriage 31 supports a guide 52 in which is mounted for axial movement therein arm 53. The radially inward end of arm 53 is rigidly attached to a generally vertically extending head support 54 on which is mounted casing handling head 55 for vertical movement thereon. Hence, it may be said that casing handling head 55 is controllably movable along two intersecting horizontally axes extending over the well bore in which the casing is to be positioned, as will be described hereinafter. This arises out of the fact that arm 53 is movable relative to guide 52 along one axis and carriage 51 is movable on track 50 along another axis. Further, it may be said that casing handling head 55 is movable along a vertical axis by virtue of the fact that the head 55 is movable on and relative to head support 54, as will be discussed hereinafter and as shown in the aforesaid U.S. Patent.

Casing handling head 55 is movable on head support 54 by operation of hydraulic lift cylinder assembly 58, the piston of which is attached to wireline 59 shown passing over sheave 60 attached in derrick 11 and having the other end thereof attached to cylinder head 55. Hence, upon operation of lift cylinder assembly 58, casing handling head 55 can be caused to move up and down on head support 54. Head support 54 has mounted on the upper end thereof guide roller 61 which is arranged to engage line 59 when the angle of incident therebetween increases sufficiently that line 59 would otherwise be interfered with by head support 54.

Figure 2:
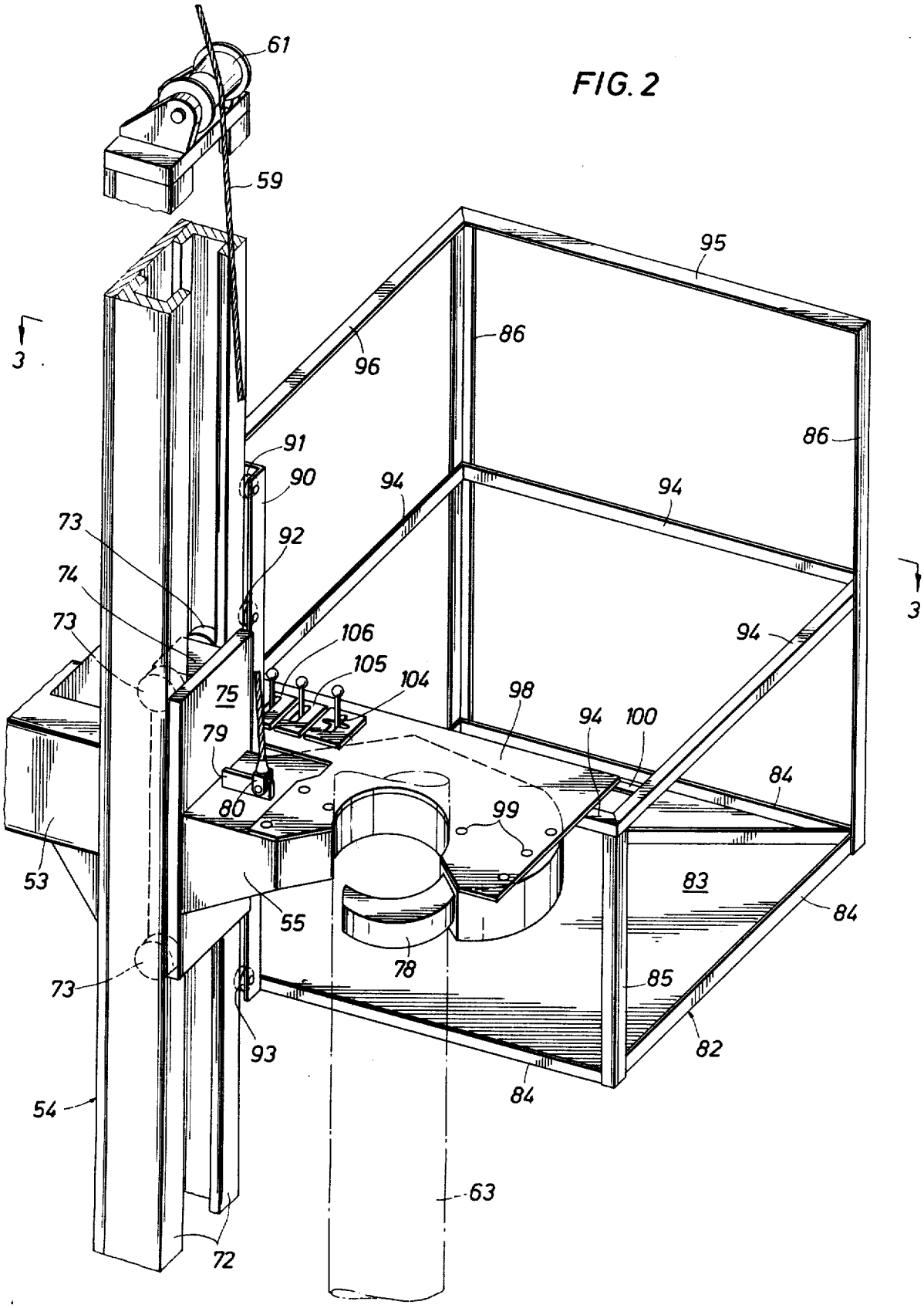
FIG. 2 is a perspective view of the operator platform portion of this invention.
Figure 3:
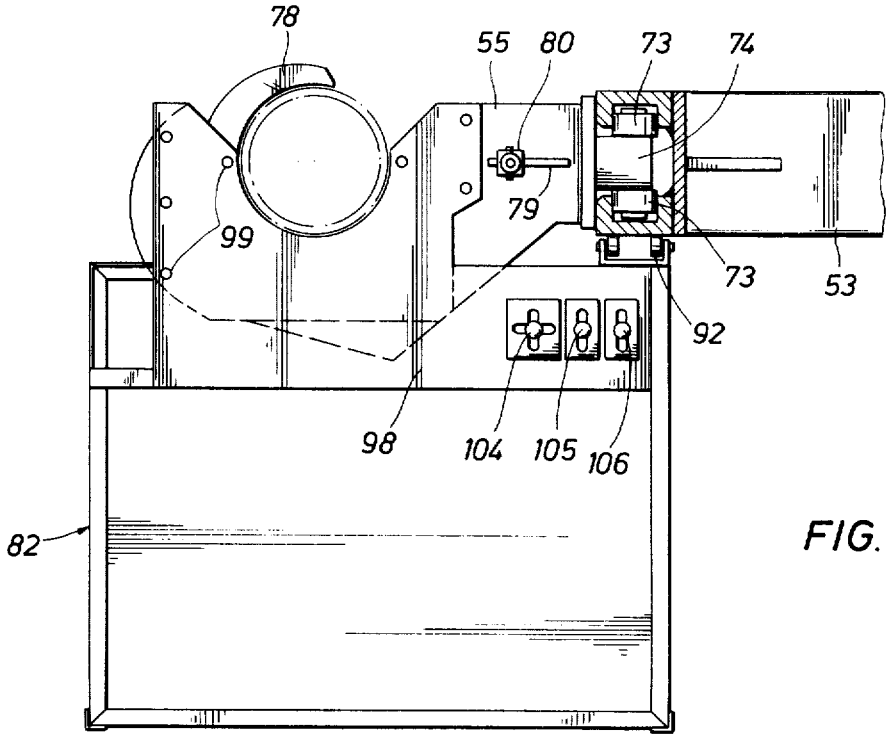
FIG. 3 is generally a cross-sectional view taken along line 3—3 of FIG. 2.

In FIG. 1, casing handling head 55 and head 45 are both shown engaged with a section of casing pipe 63 and holding the same against lateral movement thereof at a point in time immediately after the lower pin end of pipe 63 had been stabbed into the box end of casing string 64 shown supported in spider 65 mounted on bearing plate 66 which, in turn, is mounted on the conventional rotary. Referring now to FIGS. 2 and 3, in particular, additional details of the apparatus will be described. In FIG. 2 it will be noted that head support 54 is comprised of two opposed channel members 72 forming a track which is arranged for engaging four rollers 73 which are attached to bearing block 74 by appropriate axles. Bearing block 74 has attached therewith support plate 75 which, in turn, has rigidly attached therewith casing handling head 55 previously identified. Head 55 includes a hydraulically actuated latch 78 which is arranged for opening and closing by a double acting hydraulic cylinder, as is well known to those skilled in the art, such that the same can be latched around and subsequently released from a section of pipe, such as casing pipe 63. It will also be observed in FIG. 2 that line 59 is connected to head 55 by means of lug 79 and connecting clevis 80.

The operator platform of this invention is generally designated by the numeral 82 and includes a metal grate floor 83 surrounded by lower cross members 84 to which are attached an intermediate length angle upright 85 on one corner and a pair of longer angle uprights 86 on the opposite side. The other corner of platform 82 has formed therein an upright U-shaped channel 90 which supports a pair of upper rollers 91, a pair of intermediate rollers 92, and a pair of lower rollers 93 which are arranged for abutment against the side of head support 54.

Platform 82 includes four intermediate cross-members 94 which are attached between uprights 85, 86 and channel member 90 to form an enclosure to protect an operator who may be positioned on floor 83. In addition, platform 82 also includes an upper crossmember 95 between uprights 86 and other crossmember 96 extending between channel 90 and the adjacent upright 86, as shown.

Platform 82 is removably attached to casing handling head 55 by means of an attaching plate 98 having a plurality of bolt holes therethrough in which are mounted appropriate bolts 99 extending into the housing portion of head 55. Plate 98 is attached to the adjacent member 94 and an auxiliary or additional crossmember 100 to give rigid support to platform 82. Upon movement of head 55, either in a horizontal plane or in a vertical direction, platform 82 moves therewith. Hence, an operator mounted on platform 82 will always be in position adjacent to casing head 55 so as to carry out certain manipulative steps which are described hereinafter.

Platform 82 has mounted thereon control means for operating head 55, and these control means take the form of horizontal control lever 104, latch control lever 105, and vertical control lever 106, all of which are mounted on attaching plate 98. Control levers 104, 105 and 106 are of conventional design and are connected to appropriate hydraulic control systems as is well known to those skilled in the art, such that horizontal control lever 104 controls movement of arm 53 and head 55 in a horizontal plane extending over the well bore. Control lever 105 controls opening and closing of latch 78, and control lever 106 controls operation of cylinder assembly 58 to thereby move head 55 up and down relative to head support 54, as discussed above.

During the running of casing pipe into a well bore, traveling block 15 is normally lowered until the lower end of upper sling 28 can be attached to a length of casing pipe which had been positioned on the pipe ramp adjacent to deck 13, and the lower end of lower sling 29 attached to the end of another section of casing pipe which is positioned on the horizontal pipe rack. Thereafter, traveling block 15 is raised upwardly, thereby drawing or raising a section of casing pipe, such as pipe 63, to a generally upright position in derrick 11 and at the same time drawing or pulling the other section of casing pipe to the pipe ramp. With upper sling 28 supporting the section of casing pipe, such as pipe 63, an operator such as operator 102 positioned on platform 82 causes casing handling head 55 to move to and be clamped around casing pipe 63 as shown in FIG. 1. It is to be understood that latch 78 will normally not be sufficiently strong to support the weight of casing pipe 63, but is sufficiently strong to move the same laterally in derrick 11. With casing pipe 63 thus grasped or engaged, operator 102 can visually observe the axial alignment of casing pipe 63 and by controlling horizontal movement of head 55, guide the pipe into the stabbing position shown in FIG. 1, while pipe 63 is lowered by lowering block 15. Operation of conventional pipe tongs then completes the makeup of casing pipe 63 with casing string 64. When thus made up, operator 102 is conveniently positioned for disengaging sling 28 and re-engaging elevator 16 with the upper end of casing pipe 63, which then forms a part of the casing string 64 for subsequent lowering of the same into the well bore, whereupon the operation described above can be repeated. Since platform 82 is movable vertically, operator 102 can readily position himself to perform various manipulative functions, such as latching and unlatching elevator 16 and unlatching sling 28, as the need arises.

In certain embodiments of the invention, platform 82 may also be provided with an additional control lever (not shown) which will operate lower head 85 which would otherwise normally be operated by an operator on deck 13, for example. In this instance, operator 102 would have complete control over the alignment procedure during the stabbing operation.

The invention provides an apparatus which permits an operator to be positioned in a location where he can carry out or assist in the stabbing operation from a vantage point which permits the stabbing operation to be made more accurately, conveniently and with less time involved. Moreover, the apparatus of this invention permits the positioning of the operator to carry out additional activities as described above, as for example, operation of the elevators, the sling and the like. Further, the apparatus provides a stable platform for supporting the operator.

Figure 4:
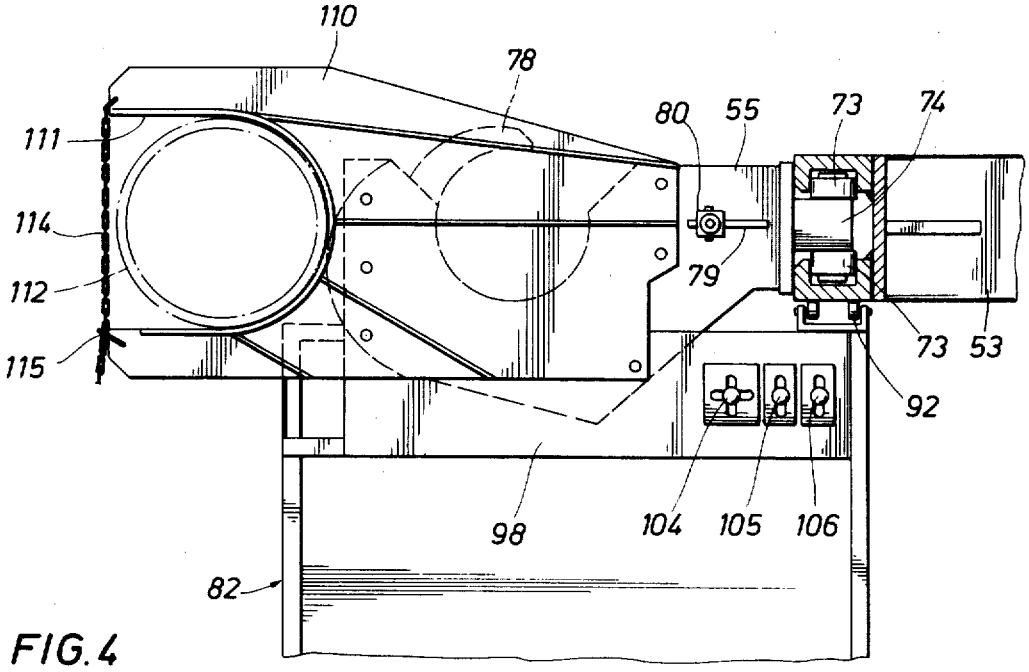
FIG. 4 is a partial sectional view similar to FIG. 3 but showing an alternate embodiment of the invention.

Referring now to FIG. 4, an alternative embodiment of the apparatus will be described. The apparatus there shown is identical with that previously described, except that an adaptor plate 110 is shown mounted over attaching plate 98, the purpose of which is to accommodate larger size casing pipe than can normally be operated by the conventional head 55. Adaptor plate 110 is attached to plate 98 by appropriate bolts and the outward end thereof is formed with a U-shaped recess 111 therein, sized for accommodation of a larger sized casing pipe such as pipe 112. Pipe 112 is retainted in recess 111 by means of a retainer chain 114 which is attached permanently at one end to one side of adapter plate 110, with the other end of retainer chain 114 having a chain latch 115 which is arranged for removable attachment to the other side of adapter plate 110, as shown in FIG. 4. Because of the proximate position of platform of platform 82, an operator positioned thereon can readily operate chain latch 115 to uncouple chain 114 when a stabbing operation is completed. With the embodiment shown in FIG. 4, the operational sequences are the same as described with the prior embodiment, except with respect to the latching and unlatching of retainer chain 114 for securing pipe 112 to head 55, rather than the operation of latch 78.

Further modifications and alternative embodiments of the apparatus and method of this invention will be apparent to those skilled in the art in view of this description. Accordingly, this description is to be construed as illustrative only and is for the purpose of teaching those skilled in the art the manner of carrying out the invention. It is to be understood that the forms of the invention herewith shown and described are to be taken as the presently preferred embodiment. Various changes may be made in the shape, size and arrangement of parts. For example, equivalent elements or materials may be substituted for those illustrated and described herein, parts may be reversed, and certain features of the invention may be utilized independently of the use of other features, all as would be apparent to one skilled in the art after having the benefit of this description of the invention.

What is claimed is:

1. Casing stabbing apparatus for running casing pipe into a well bore, the combination comprising:

a casing handling head for grasping a generally upright section of casing pipe, said head being controllably movable along two intersecting horizontal axes extending over said well bore and along a vertical axis;

platform means attached to said head for movement therewith and for supporting an operator thereon;

and control means carried by said platform means for operating said head, whereby an operator supported on said platform means can guide said casing pipe to the stabbing position and then release the same by operating said control means.

2. Casing stabbing apparatus for running casing into a well bore, the combination comprising:

a casing handling head adapted for grasping a generally upright section of casing pipe near the upper end thereof, said head being controllably movable in a horizontal plane extending over said well bore and along a vertical axis;

an operator platform attached to said head for movement therewith;

and control means carried by said platform for operating said head, whereby an operator supported on said platform can visually observe and guide the stabbing of a section of casing pipe and then release the same by operating said control means.

3. The invention as claimed in claim 2 wherein:

said platform is removably attached to said head.

4. The invention as claimed in claim 2 said casing handling head includes:

an adapter plate attached to said casing head, said plate having a recess thereon for accommodating a section of casing pipe;

said retainer means operable from said platform for retaining said section of casing pipe therein.

5. The invention as claimed in claim 2 wherein:

said platform includes side closures members forming an enclosed space for accommodating an operator therein.

6. The invention as claimed in claim 2 including:

a second casing handling head adapted for grasping said generally upright section of casing pipe at a point below said first head, said second head being controllably movable in another horizontal plane extending over said well bore and along a vertical axis;

and additional control means carried by said platform for operating said second head.

7. In a casing stabbing apparatus for running casing pipe into a well bore, the combination comprising:

a casing handling head adapted for grasping a generally upright section of casing pipe and urging the same literally, said head being controllably movable in a horizontal plane extending over said well bore and along a vertical axis;

an operation platform attached to said head for movement therewith;

manually operate controls carried by said platform for operating said head to cause movement of said head in said horizontal plane and vertically, and to cause latching onto and release of said casing pipe by said head, whereby an operator supported on said platform can cause said head to latch onto said casing pipe visually observe and guide stabbing thereof, and then release the same by operating said controls.

* * * * *